US010328559B2

(12) United States Patent
Rompel et al.

(10) Patent No.: US 10,328,559 B2
(45) Date of Patent: Jun. 25, 2019

(54) DRILL

(71) Applicant: BLACK & DECKER INC., New Britain, CT (US)

(72) Inventors: Markus Rompel, Runkel (DE); Rafael Glottschling, Selters-Eisenbach (DE)

(73) Assignee: Black & Decker Inc., New Britain, CT (US)

( * ) Notice: Subject to any disclaimer, the term of this patent is extended or adjusted under 35 U.S.C. 154(b) by 611 days.

(21) Appl. No.: 14/959,371

(22) Filed: Dec. 4, 2015

(65) Prior Publication Data

US 2016/0193726 A1 Jul. 7, 2016

(30) Foreign Application Priority Data

Dec. 4, 2014 (GB) ..... 1421577.6

(51) Int. Cl.

| | |
|---|---|
| ***B25D 16/00*** | (2006.01) |
| ***B25D 11/06*** | (2006.01) |
| ***B25B 23/14*** | (2006.01) |
| ***B25B 21/02*** | (2006.01) |
| ***B25F 5/00*** | (2006.01) |
| ***B25D 11/12*** | (2006.01) |

(52) U.S. Cl.

CPC ..... *B25D 16/003* (2013.01); *B25B 21/023* (2013.01); *B25B 21/026* (2013.01); *B25B 23/141* (2013.01); *B25D 11/068* (2013.01); *B25D 11/125* (2013.01); *B25F 5/001* (2013.01); *B25D 2250/025* (2013.01)

(58) Field of Classification Search

CPC .. B25D 16/003; B25D 11/068; B25D 11/125; B25D 2250/025; B25B 21/023; B25B 21/026; B25B 23/141

USPC ..... 173/48, 93, 93.5, 93.6, 93.7

See application file for complete search history.

(56) References Cited

U.S. PATENT DOCUMENTS

| | | | | |
|---|---|---|---|---|
| 2,712,254 A | | 7/1955 | Schodeberg | |
| 2,836,272 A | * | 5/1958 | Kaman | B25B 21/026 173/93.6 |
| 2,940,565 A | | 6/1960 | Schodeberg | |

(Continued)

FOREIGN PATENT DOCUMENTS

| | | |
|---|---|---|
| EP | 2069107 | 4/2008 |

OTHER PUBLICATIONS

Extended European search report dated May 12, 2016 issued in corresponding EP patent application.

(Continued)

*Primary Examiner* — Alexander M Valvis
*Assistant Examiner* — Eduardo R Ferrero
(74) *Attorney, Agent, or Firm* — Amir Rohani

(57) ABSTRACT

A drill includes a housing and a motor having a drive spindle. An output spindle is capable of being rotationally driven by the drive spindle via a torque clutch. The drill further includes a tangential impact mechanism for superimposing tangential impacts onto the output spindle when activated. The tangential impact mechanism includes a sleeve rotatably mounted on the output spindle, and an anvil rotatably mounted onto the output spindle. The sleeve is rotationally driven by the drive spindle via a gear system at a first rotational rate when the torque clutch is not slipping and at a second rotational rate when the torque clutch is slipping.

34 Claims, 7 Drawing Sheets

(56) References Cited

U.S. PATENT DOCUMENTS 3,305,031 A * 2/1967 Bez ..... B25D 11/005 173/115
3,369,615 A * 2/1968 Maffey, Jr. ..... B25B 21/026 173/93.6
3,428,137 A * 2/1969 Schaedler ..... B25B 21/02 173/93.6
3,610,344 A * 10/1971 Schoeps ..... B25B 21/026 173/93.5
3,718,193 A * 2/1973 Wanner ..... B25D 11/125 173/117
3,834,252 A * 9/1974 Abell ..... B25B 23/14 192/108
3,835,715 A * 9/1974 Howell ..... B25D 11/106 173/109
4,071,092 A 1/1978 Wallace
4,088,197 A 5/1978 Roll
4,236,588 A * 12/1980 Moldan ..... B25D 16/006 173/48
4,313,505 A * 2/1982 Silvern ..... B25B 21/026 173/93.5
4,763,733 A * 8/1988 Neumaier ..... B25D 16/006 173/109
5,346,023 A * 9/1994 Takagi ..... B25D 16/003 173/109
5,908,076 A 6/1999 Marcengill et al.
5,992,538 A 11/1999 Marcengill et al.
6,089,330 A 7/2000 Miescher et al.
6,142,242 A * 11/2000 Okumura ..... B25B 23/141 173/216
6,431,289 B1 8/2002 Potter
6,457,535 B1 10/2002 Tanaka
7,051,820 B2 * 5/2006 Stirm ..... B25D 16/00 173/109
7,131,503 B2 * 11/2006 Furuta ..... B25B 21/00 173/48
7,216,749 B2 * 5/2007 Droste ..... B25D 16/003 192/56.61
7,410,007 B2 8/2008 Chung et al.
7,455,615 B2 11/2008 Chen
7,494,437 B2 2/2009 Chen
7,506,694 B2 * 3/2009 Stirm ..... B25F 5/00 173/176
7,588,093 B2 9/2009 Grand et al.
7,980,324 B2 * 7/2011 Bixler ..... B25F 5/001 173/176
8,042,621 B2 10/2011 Barezzani
8,172,004 B2 5/2012 Ho
8,191,649 B2 * 6/2012 Zhu ..... B25B 21/02 173/104
8,371,394 B2 * 2/2013 Grand ..... B25B 21/02 173/29
8,584,770 B2 11/2013 Zhang
8,794,348 B2 8/2014 Rudolph
8,827,003 B2 9/2014 Nagasaka
9,289,886 B2 * 3/2016 Limberg ..... B25B 21/026
9,339,923 B2 * 5/2016 Aoki ..... B25D 16/003
9,415,489 B2 * 8/2016 Xu ..... B25B 21/026
9,630,307 B2 * 4/2017 Ludy ..... B25D 11/04
2002/0050367 A1 * 5/2002 Manschitz ..... B25D 11/125 173/216
2002/0108766 A1 * 8/2002 Plank ..... B25D 11/005 173/171
2005/0199404 A1 * 9/2005 Furuta ..... B25B 21/00 173/48
2006/0108133 A1 * 5/2006 Yamazaki ..... B25D 11/005 173/104
2006/0137889 A1 * 6/2006 Hanke ..... B25D 11/125 173/114
2006/0159577 A1 * 7/2006 Soika ..... B25D 11/125 417/572
2006/0237206 A1 * 10/2006 Schamberger ..... B25D 11/125 173/201
2007/0079979 A1 4/2007 Braun
2007/0181319 A1 8/2007 Whitmire et al.
2007/0289759 A1 * 12/2007 Hartmann ..... B25B 21/02 173/48
2008/0073094 A1 * 3/2008 Lu ..... B25B 21/02 173/104
2008/0105448 A1 * 5/2008 Hahn ..... B25B 23/141 173/178
2008/0283264 A1 * 11/2008 Ikuta ..... B25D 11/125 173/211
2008/0308286 A1 12/2008 Puzio
2009/0056966 A1 * 3/2009 Grand ..... B25B 21/02 173/93.5
2009/0188689 A1 * 7/2009 Stirm ..... B25D 16/003 173/114
2009/0266572 A1 * 10/2009 Meixner ..... B25D 11/125 173/205
2010/0000749 A1 1/2010 Andel
2010/0000750 A1 * 1/2010 Andel ..... B25B 21/00 173/48
2010/0186977 A1 * 7/2010 Zhang ..... B25B 21/00 173/48
2010/0276169 A1 11/2010 Grand
2011/0011606 A1 1/2011 Whitmire et al.
2011/0114348 A1 * 5/2011 Braun ..... B25D 11/125 173/109
2012/0132452 A1 * 5/2012 Hoop ..... B25B 21/02 173/93.5
2012/0255755 A1 10/2012 Kondo
2013/0112448 A1 * 5/2013 Profunser ..... B25B 21/026 173/93.5
2013/0133911 A1 * 5/2013 Ishikawa ..... B25B 21/00 173/176
2014/0338946 A1 11/2014 Herr

OTHER PUBLICATIONS

European Office Action dated Dec. 23, 2016 issued in corresponding EP patent application.

* cited by examiner

DRILL

FIELD

The present invention relates to a drill and in particular, to a hammer drill.

BACKGROUND

A hammer drill typically includes a tool holder in which a cutting tool, such as a drill bit, can be supported and driven by the hammer drill. The hammer drill can often drive the cutting tool in three different ways, each being referred to as a mode of operation. The cutting tool can be driven in a hammer only mode, a rotary only mode and a combined hammer and rotary mode.

A hammer drill will typically comprise an electric motor and a transmission mechanism by which the rotary output of the electric motor can either (a) rotationally drive the cutting tool to perform the rotary only mode or repetitively strike the end of a cutting tool to impart axial impacts onto the cutting tool to perform the hammer only mode or (b) rotationally drive and repetitively strike the cutting tool to perform the combined hammer and rotary mode. European Patent Application No. EP1674207 describes an example of such a hammer drill.

US Publication No. 2005/0173139 describes an impact driver with a tool holder in which a tool, such as a screw driver bit, can be supported and rotationally driven by the impact driver. The impact driver has a tangential impact mechanism which is activated when a large torque is experienced by the tool. The tangential impact mechanism imparts tangential (circumferential or rotational) impacts onto the tool until the torque applied to the tool drops below a predetermined value.

It is known to provide hammer drills with an additional tangential impact mechanism so that the hammer drill can impart rotational impacts onto a cutting tool in addition to axial impacts. U.S. Pat. No. 7,861,797, PCT Publication No. WO2012/144500 and German Patent Document No. DE1602006 all disclose such hammer drills. In each of these hammer drills the additional tangential impact mechanism is rotationally driven at a same rate as the rate of rotation of the hammer drills output spindle.

The object of the present invention is to provide a drill with an additional tangential impact mechanism which has an improved operational performance.

SUMMARY

A drill includes a tangential impact mechanism which is activated when a restive torque above a predetermined value is applied to the spindle of the drill. Such arrangement provides the ability to rotatingly drive the output spindle at a first speed during the normal course of drilling while allowing the tangential impact mechanism to be driven at a second different rotational speed when the tangential impact is caused to be activated. This allows both the drilling performance of the drill and impacting performance of tangential impact mechanism to be optimised as they can both run at desired speeds which are different to each other.

BRIEF DESCRIPTION OF THE DRAWINGS

An embodiment of the present invention will now be described with reference to accompanying drawings of which.

DETAILED DESCRIPTION

An embodiment of the present invention will now be described with reference to FIGS. 1 to 7.

Figure 1:
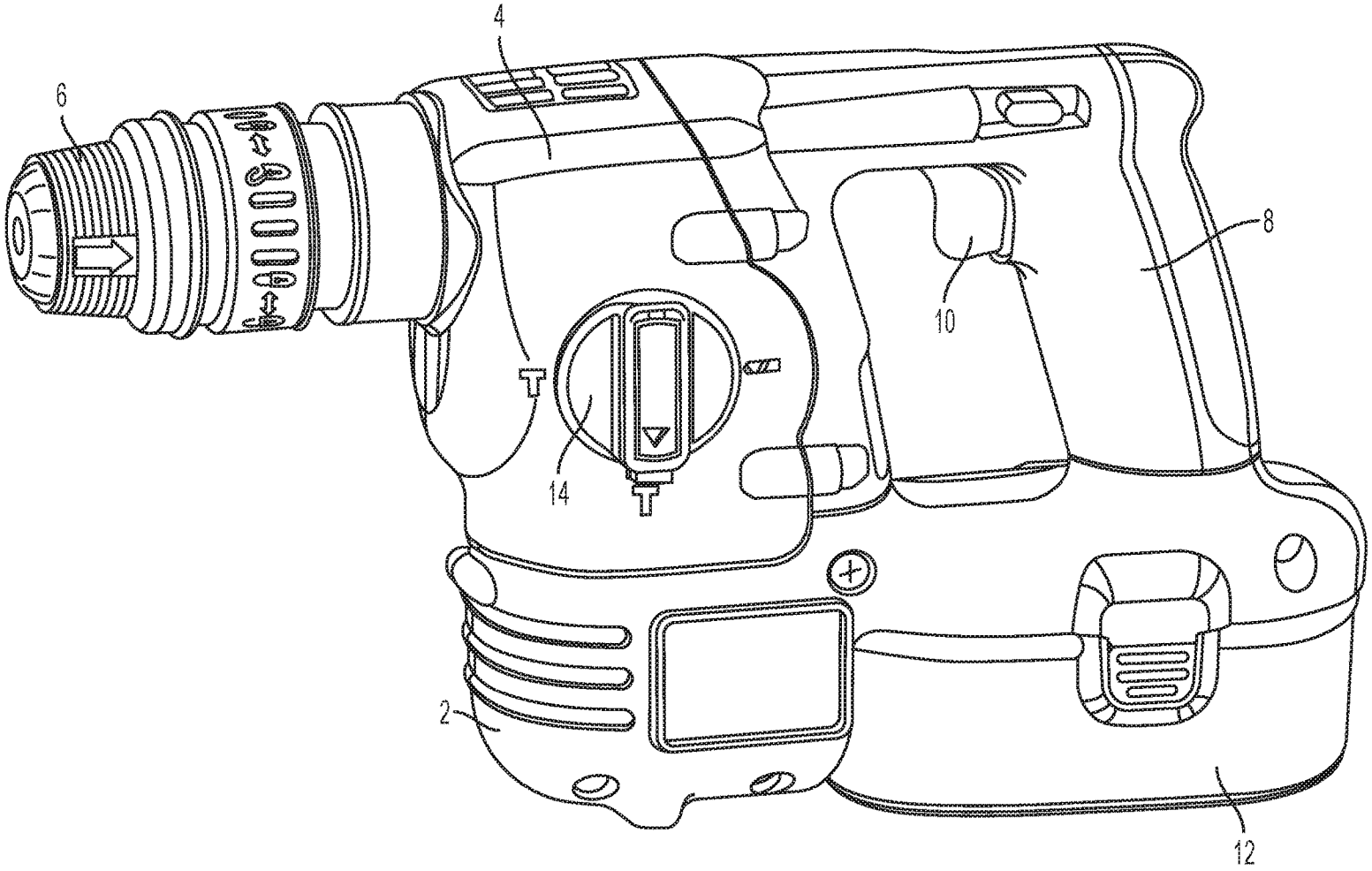
FIG. 1 shows a side view of a hammer drill with an additional tangential impact mechanism in accordance with the present invention.

Referring to FIG. 1, the hammer drill comprises a motor housing 2. An electric motor 100 is preferably disposed within motor housing 2.

The hammer drill further includes a transmission housing 4, which preferably houses a hammer mechanism (which is described in more detail below) to impart axial impacts onto a cutting tool, a rotary drive (which is described in more detail below) to rotationally drive a cutting tool and a tangential (rotational) impact mechanism (which is described in more detail below) to impart tangential impacts to a cutting tool.

A tool holder 6 may be attached to the front of the transmission housing 4 which is capable of supporting a cutting tool to be driven by the hammer drill.

A handle 8 may be attached at one end to the motor housing 2 and at the other end to the transmission housing 4. A trigger button 10 is preferably mounted within the handle 8 and is used by the operator to activate the electric motor 100. A battery pack 12 may be attached to the base of the handle 8 for providing electrical power to the motor 100.

A mode change knob 14 may be mounted on the side of the transmission housing 2. The knob 14 can be rotated to three different positions to change the mode of operation of the hammer drill between hammer only mode, rotary only mode and combined rotary and hammer mode.

Figure 2:
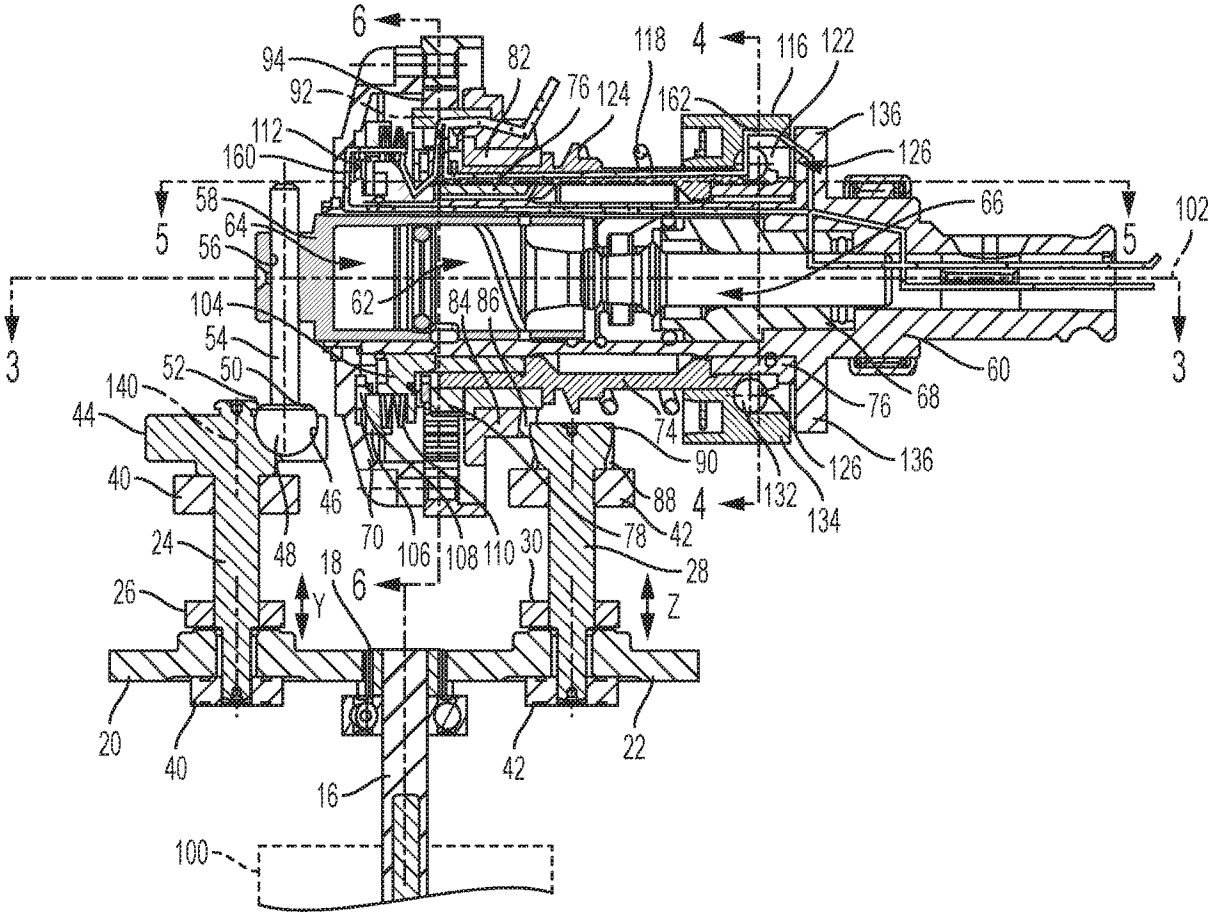
FIG. 2 shows a vertical cross section of the rotary drive, the hammer mechanism and the tangential impact mechanism of the hammer drill shown in FIG. 1.
Figure 3:
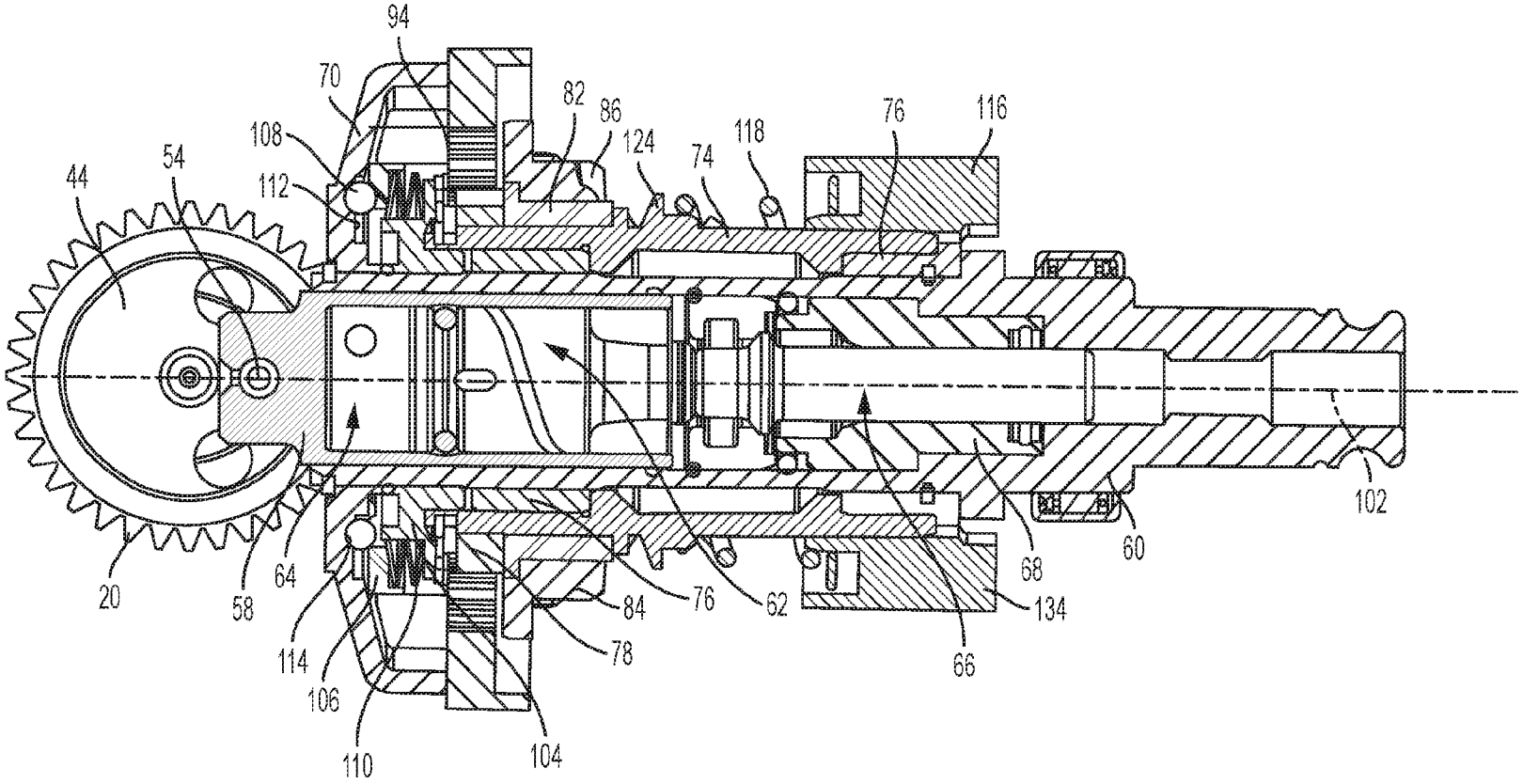
FIG. 3 shows a horizontal cross section of the rotary drive, the hammer mechanism and the tangential impact mechanism of the hammer drill in the direction of Arrows B in FIG. 2.
Figure 4:
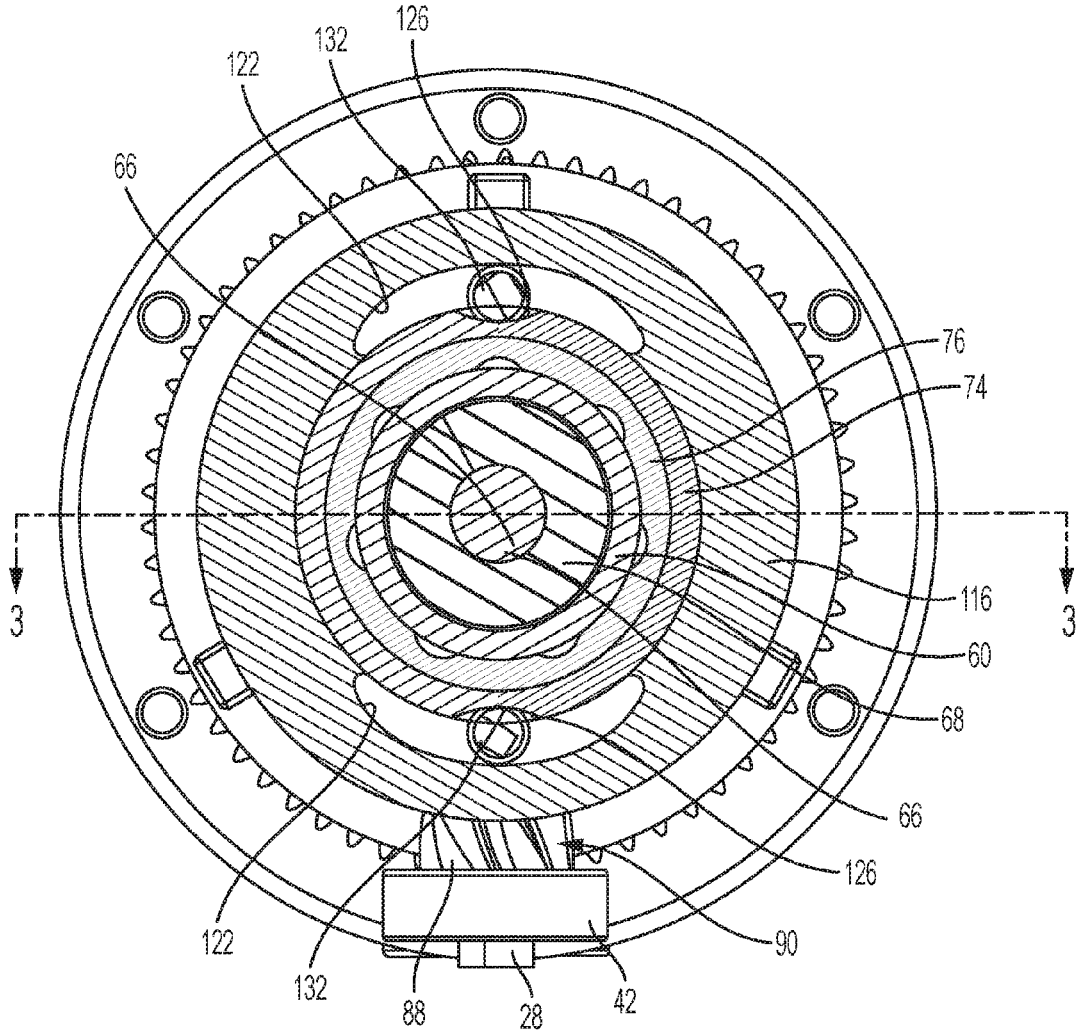
FIG. 4 shows a vertical cross section of the spindle and the tangential impact mechanism of the hammer drill in the direction of Arrows C in FIG. 2.
Figure 5:
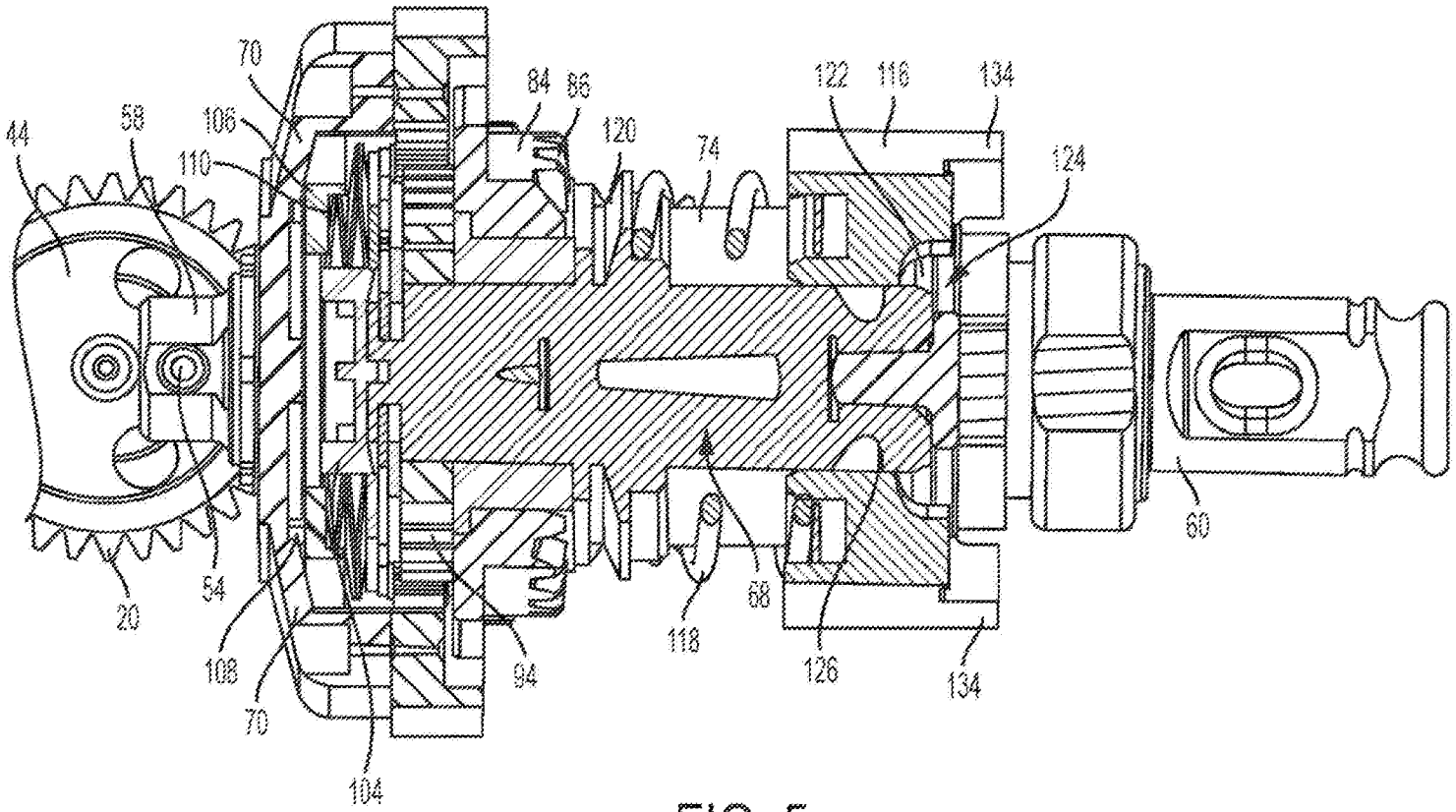
FIG. 5 shows a horizontal cross section of the rotary drive, the hammer mechanism and the tangential impact mechanism of the hammer drill in the direction of Arrows D in FIG. 2.

Referring to FIG. 2, the motor 100 has a drive spindle 16 with teeth 18 which mesh with two gears 20, 22. The first gear 20 is capable of being drivingly connected to a first shaft 24 (which is rotationally mounted within the transmission housing 2 by bearings 40) via a first sleeve 26. The first sleeve 26 can axially slide in the direction of Arrow Y along the first shaft 24 and is preferably rotationally fixed to the first shaft 24. The first gear 20 can freely rotate on the first shaft 24. The side of the first sleeve 26 comprises teeth (not shown) which can engage with teeth (not shown) formed on the side of the first gear 20 when the first sleeve 26 is moved into engagement with the first gear 24 to drivingly connect the first sleeve 26 with the first gear 20. When the first sleeve 26 is drivingly engaged with the first gear 20, the rotational movement of the first gear 20 is transferred to the first shaft 24.

The second gear 22 is capable of being drivingly connected to a second shaft 28 (which is preferably rotationally mounted within the transmission housing 2 by bearings 42) via a second sleeve 30. The second sleeve 30 can axially slide in the direction of Arrow Z along the second shaft 28 and is preferably rotationally fixed to the second shaft 28. The second gear 22 can freely rotate on the second shaft 28. The side of the second sleeve 30 comprises teeth (not shown) which can engage with teeth (not shown) formed on the side of the second gear 22 when the second sleeve 30 is moved into engagement with the second gear 22 to drivingly connect the second sleeve 30 with the second gear 22. When the second sleeve 30 is drivingly engaged with the second gear 22, the rotational movement of the second gear 22 is transferred to the second shaft 28.

The movement of the two sleeves 26, 30 is controlled by a mode change mechanism, designs of which are well known in art. For example, the sleeves 26, 30 can be moved by a see-saw arrangement similar to that described in U.S. Pat. No. 8,430,182, which is wholly incorporated herein by reference. By moving the first sleeve 26 only into engagement with the first gear 20, the second sleeve 30 only into engagement with the second gear 22, or both sleeves 26, 30 into engagement with their respective gears 20, 22, the mode of operation of the hammer drill can be changed between hammer only mode, rotary only mode and combined rotary and hammer mode respectively. The mode change mechanism is preferably controlled by rotation of the mode change knob 14.

Crank plate 44 may be rigidly attached to the top of the first shaft 24. A recess 46 may be formed within the crank plate 44 in which a part spherical ball 48 is disposed therewithin. The part spherical ball 48 can pivot over a range of angles within the recess 46. The part spherical ball 48 is preferably prevented from exiting the recess 46 by a shoulder 50 engaging with a lip 52 formed on the crank plate 44.

A drive shaft 54 may be rigidly connected to and extend from the part spherical ball 48. The shaft 54 preferably passes through and is capable of axially sliding within a tubular passage 56 formed in the rear of a hollow piston 58 which is mounted within the rear end of a hollow output spindle 60. Rotation of the crank plate 44 results in a reciprocating movement of the hollow piston 58 within the hollow output spindle 60.

A ram 62 may be mounted within the hollow piston 58 which is preferably reciprocatingly driven by the hollow piston 58 via an air spring 64. The ram 62 may repetitively strike a beat piece 66 mounted within a beat piece support structure 68 inside of the hollow spindle 60, which in turn may repetitively strikes an end of a cutting tool held by the tool holder 6 inside the front end of the hollow spindle 60.

Figure 6:
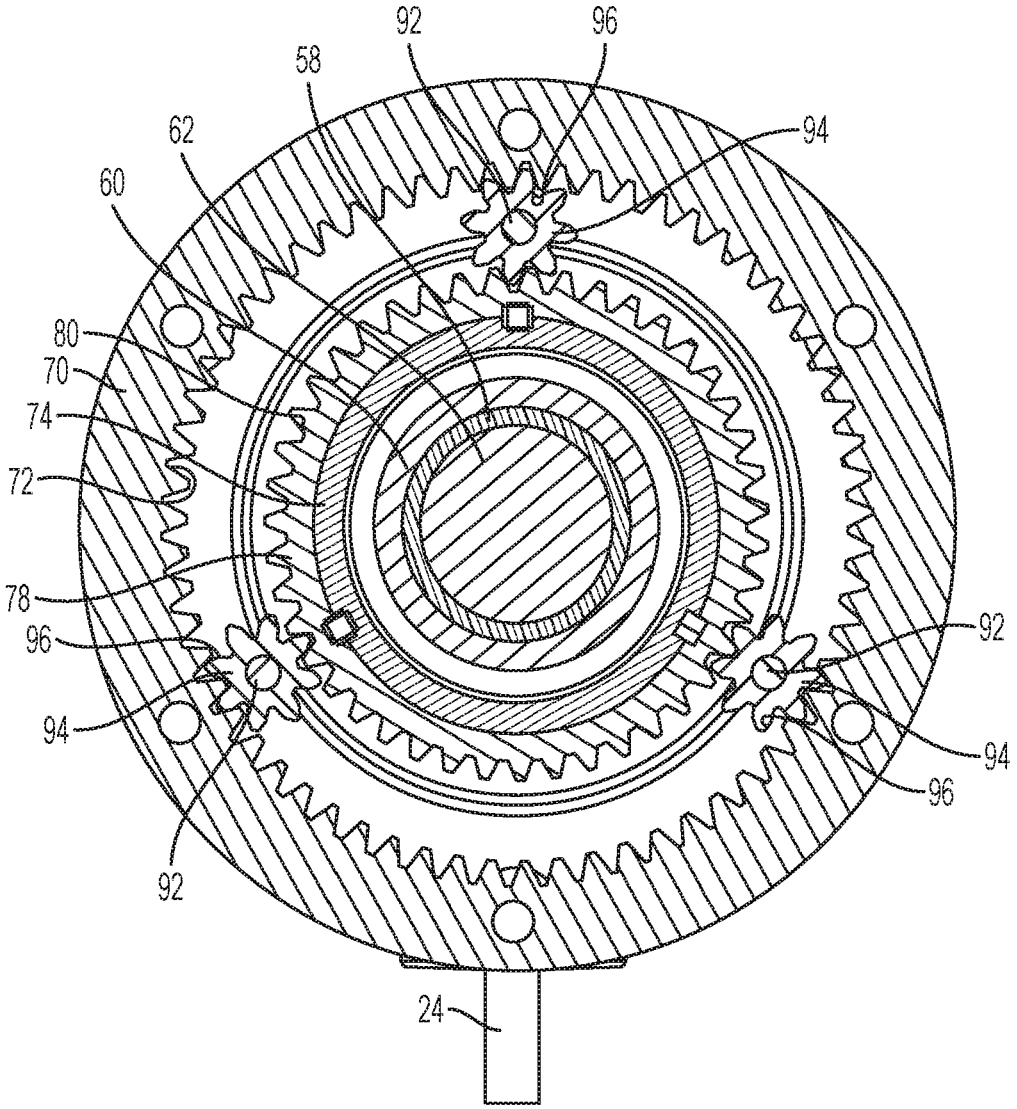
FIG. 6 shows a vertical cross section of the planetary gear mechanism of the hammer drill in the direction of Arrows E in FIG. 2.
Figure 7:
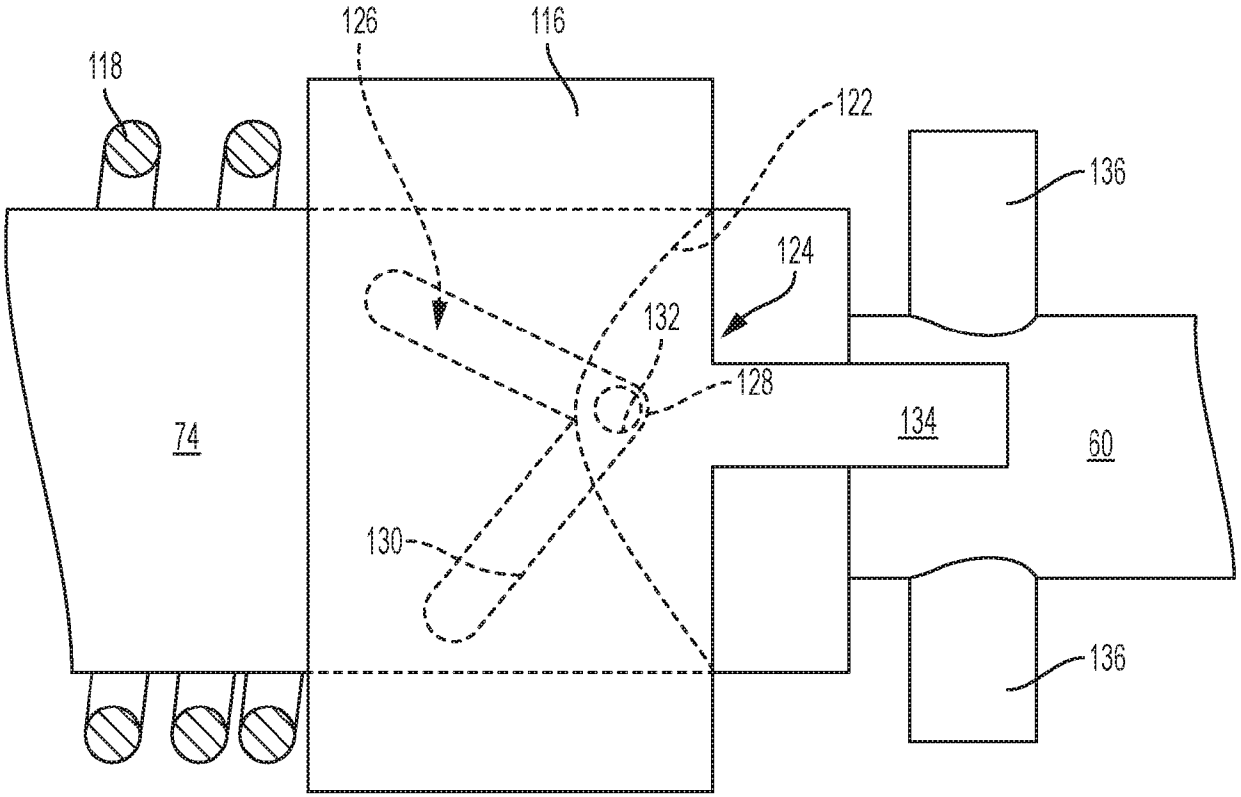
FIG. 7 shows a sketch of the spindle, sleeve with the V shaped grooves, the anvil, the U shaped recesses and the interconnecting ball bearings.

A cup shaped gear 70 is preferably mounted on the rear part of the hollow output spindle 60 in a rigid manner. Teeth 72 may be formed on an inner wall of the cup shaped gear 70 facing inwardly towards the hollow spindle 60 as best seen in FIG. 6. Rotation of the hollow spindle 60 about its longitudinal axis 102 preferably results in rotation of the cup shaped gear 70 and vice versa.

A sleeve 74 may be rotationally mounted on the hollow spindle 60 via bearings 76. The sleeve 74 is preferably axially fixed relative to the hollow spindle 60. The rear end of the sleeve 74 preferably extends inside of the cup shaped gear 70. An annular shaped gear 78 may be rigidly mounted on the rear end of the sleeve 74 inside of the cup shaped gear 70 which has teeth 80 which face away radially outwardly from the hollow spindle 60 towards the teeth 72 of the cup shaped gear 70. Rotation of the sleeve 74 preferably results in rotation of the annular shaped gear 78 and vice versa.

A sliding bearing 82 is preferably mounted on the sleeve 74. A ring shaped first bevel gear 84 in turn may be mounted on the sliding bearing 82. The first bevel gear 84 is preferably capable of freely rotating around the sleeve 74 on the slide bearing 82 but is axially fixed relative to the sleeve 74. The first bevel gear 84 preferably comprises teeth 86 which mesh with teeth 88 of a second bevel gear 90 rigidly attached to the second shaft 28. Rotation of the second shaft 28 preferably results in rotation of the second bevel gear 90 which in turn rotates the first bevel gear 84 on the slide bearing 82 around the sleeve 74.

Three pins 92 may be attached to the side of the first bevel gear 84 in angular positions of 120 degrees relative to each other. The pins 92 may extend rearwardly in parallel to the longitudinal axis 102 of the hollow spindle 60 and to each other into the inside of the cup shape gear 70.

A circular gear 94 with teeth 96 may be mounted on each pin 92 in a freely rotatable manner. The teeth 96 of all three circular gears 94 preferably mesh with both the teeth 72 of the cup shaped gear 70 and the teeth 80 of the annular shaped gear 78. The three circular gears 94, the cup shaped gear 70, the annular shaped gear 78 and the first bevel gear 84 form a planetary gear system with the three circular gears 94 forming the planetary gears, the cup shaped gear 70 forming a ring gear, the annular shaped gear 78 forming the sun gear and the first bevel gear 84 forming the carrier for the planetary gears 94.

A clutch sleeve 104 may be rigidly attached to the rear of the sleeve 74. A ring shaped ball bearing cage 106 is preferably mounted on the clutch sleeve 104. Ball bearing cage 106 preferably holds a number of ball bearings 108 in preset positions within the ball bearing cage 106 but in a freely rotatable manner. The ball bearing cage 106 can axially slide on the clutch sleeve 104 but may be rotationally fixed to the clutch sleeve 104.

Four bevel washers 110 may be sandwiched between the clutch sleeve 104 and ball bearing cage 106. The bevel washers 110 preferably act as a spring, urging the ball baring cage 106 rearwardly towards a side wall 112 of the cup shaped gear 70.

A groove (not shown) is preferably formed within the side wall 112 around the axis 102 of the hollow spindle 60. This groove may act as a path for the ball bearings 108. Indentations 114 are preferably formed along the path. The number of indentations 114 preferably corresponds to the number and relative positions of the ball bearings 108. The ball bearings 108 are held within the path and indentations by the ball bearing cage 106 which presses them against the wall 112 due to the biasing force of the bevel washers 110. Persons skilled in the art shall recognize that the clutch sleeve 104, the bevel washers 110, the ball bearing cage 106, the ball bearings 108 and the path with the indentations 114 within the wall 112 of the cup shaped gear 70 effectively form a torque clutch.

An anvil 116 is preferably mounted on the sleeve 74. The anvil 116 can axially slide along the sleeve 74 or rotate around the sleeve 74. Formed on the inside of the anvil 116, on opposite sides of the sleeve 74 in a symmetrical manner, are two U shaped recesses 122 (shown as dashed lines in FIG. 7) having the same dimensions, the entrances 124 of which face forward. The height of the U shaped recess 122 is preferably constant across the length and width of the U shaped recess 122.

Two V shaped grooves 126 may be formed on the outside of the sleeve 74, on opposite sides of the sleeve 74 in a symmetrical manner. Preferably, the apexes 128 of the two V shaped grooves point forward. Each arm 130 of each of the V shaped grooves 126 preferably extends both around the sleeve 74 and rearwardly (left in FIG. 2) along the sleeve 74 in a spiral manner, the arms 130 of each V shaped groove 126 being preferably symmetrical with the other arm 130 of the same V shaped groove 126.

The anvil 116 is preferably mounted on the sleeve 74 so that each U shaped recess 122 locates above and faces towards a V shaped groove 126. A ball bearing 132 is preferably located in each V shaped groove 126. The diameter of these two ball bearings 132 may be equal. Preferably the diameter of the ball bearings 132 is greater than the depth of the V shaped grooves 126. Therefore the side of the ball bearings 132 preferably project into the U shaped recesses 122. The diameter of the ball bearings 132 is slightly less than the combined depth of the V shaped grooves and height of the U shaped recesses 122 so that the ball bearings are held within the V shaped grooves 126 by an inner wall of the U shaped recesses 122.

A helical spring 118 may be sandwiched between the anvil 116 and a shoulder 120 formed on the sleeve 74 to urge the anvil 116 in a forward (right in FIG. 2) direction. When the anvil 116 is urged forward, the ball bearings 132 engage with the rear walls of the U shaped recesses 122 and are then urged forward. As the ball bearing 132 are moved forward, they move along an arm 130 of a V shaped groove 126 until they reach the apex 128. The apex 130 of the V shaped grooves prevents any further forward movement of the ball bearings 132. The ball bearings 132 in turn prevent any further forward movement of the anvil 116. The ball bearings 132, V shaped grooves 126 and U shaped recesses 122 together with the spring 118 form a cam system by which the relative axial position of the anvil 116 on the sleeve 74 is controlled as the anvil 116 rotates relative to the sleeve 74.

Formed on the front of the anvil 116, on opposite sides of the anvil 116, in a symmetrical manner are two protrusions 134 which extend in a forward direction (right in FIG. 2) parallel to the longitudinal axis 102 of the spindle 60. Formed on opposite sides of the spindle 60 in a symmetrical manner are two impact arms 136 which extend perpendicularly to the longitudinal axis 102 of the spindle 60 away from the spindle 60 in opposite directions. When the ball bearings 132 are located at the apex of the V shaped grooves 126, resulting in the anvil 116 being in its most forward position, the two protrusions 134 extend in a forward direction past the two impact arms 136. The length of the impact arms 136 is such that if the spindle 60 rotates relative to the sleeve 74 (with the anvil 116 which is mounted on and connected to the sleeve 74 via the cam system) and the anvil 116 is in its most forward position, the side surfaces of the impact arms 136 would engage with the side surfaces of the protrusions 134 and prevent any further rotation of the anvil 116.

The spring 118, anvil 116, sleeve 74, V shaped grooves 126, the ball bearings 132, the U shaped recesses 122, and protrusions 134 form a tangential impact mechanism which imparts tangential strikes onto the side surfaces of the impact arms 136 of the spindle 60.

The operation of the hammer drill will now be described.

In order to operate the hammer drill in hammer only mode, the first sleeve 26 is moved into driving engagement with the first gear 20 (downwards in FIG. 2) while the second sleeve 30 is moved out of driving engagement with the second gear 22 (upwards in FIG. 2) by the mode change mechanism. As such, the rotation of the first gear 20 results in rotation of the first shaft 24 while the rotation of the second gear 22 is not transferred to the second shaft 28. Therefore rotation of the drive spindle 16 results in rotation of the first shaft 24 only via the first gear 20 and the first sleeve 26.

Rotation of the first shaft 24 results in rotation of the crank plate 44 which in turn results in the rotation of spherical ball 48 and the drive shaft 54 around the axis 140 of the first shaft 24. As the drive shaft 54 can only slide within the tubular passage 56 of the hollow piston 58 which passage 56 extends perpendicularly to the axis 102 of the spindle 60, it will always extend in a direction perpendicular to the axis 102 of the spindle 60 and therefore the whole of the drive shaft 54 moves left and right (as shown in FIG. 2) in a reciprocating manner in a direction parallel to the axis 102 of the spindle 60 while pivoting about the axis 102 of the spindle 60 at the same time.

As the drive shaft 54 reciprocatingly moves left and right in a direction parallel to the axis of the spindle 60, it reciprocatingly moves the hollow piston 54 within the spindle 60. The reciprocating movement of the hollow piston 58 is transferred to the ram 62 via an air spring 64. The reciprocating ram 62 repetitively strikes the beat piece 66 which in turn repetitively strikes a cutting tool held within the end of the spindle 60 by the tool holder 6.

In order to operate the hammer drill in rotary only mode, the first sleeve 26 is moved out of driving engagement with the first gear 20 (upwards in FIG. 2) while the second sleeve 30 is moved into driving engagement with the second gear 22 (downwards in FIG. 2) by the mode change mechanism. As such, rotation of the second first gear 22 results in rotation of the second shaft 28 while the rotation of the first gear 20 is not transferred to the first shaft 24. Therefore, rotation of the drive spindle 16 results in rotation of the second shaft 28 only via the second gear 22 and the second sleeve 30.

Rotation of the second shaft 28 results in rotation of the second bevel gear 90 which in turn results in the rotation of the first bevel gear 84 about the axis of the spindle 60. This in turn results in the three pins 92 moving sideways, perpendicularly to their longitudinal axes, around the axis 102 of the spindle 60. This in turn results in the three circular gears 94 rotating around the axis 102 of the spindle 60.

Under normal operating conditions, the amount of restive torque on the hollow spindle 60 is low and therefore is less than that of the threshold of the torque clutch. As such, the ball bearings 108 of the torque clutch remain held within the indentations 114 in path on the side wall 112 of the cup shaped gear 70 due to spring force of the bevel washers 110. Therefore, the cup shape gear 70 is held rotationally locked to the clutch sleeve 104 which in turn results in the cup shaped gear 70 being rotationally locked to the annular shaped gear 78. As such there is no relative rotation between the cup shaped gear 70 and the annular shaped gear 78. This is referred to the torque clutch "not slipping".

The circular gears 94 are drivingly engaged with both the cup shaped gear 70 and the annular shaped gear 78. Therefore, as the pins 92 rotate around the axis 102 of the spindle 60, the three circular gears 94 also rotate around the axis 102 causing both the cup shaped gear 70 and the annular shaped gear 78, which are rotationally locked to each other, also to rotate around the axis 102 in unison. As the cup shaped gear 70 and the annular shaped gear 78 are rotationally locked to each other and move in unison, the three circular gears 94 do not rotate around the pins 92 upon which they are mounted.

As such, the spindle 60, which is rigidly connected to the cup shape gear 70, also rotates around the axis 102. This in turn rotatingly drives the tool holder 6 which in turn rotatingly drives any cutting tool held the tool holder within the end of the spindle 60. The sleeve 74, which is rigidly connected to annular shape gear 78, also rotates an as the cup shaped gear 70 and the annular shaped gear 78 are rotationally locked to each other. As such, the sleeve 74 will rotate at the same rate and in the same direction as the spindle 60. As there is no relative rotation between the sleeve 74 and spindle 60, there is no movement of the anvil 116 and therefore the tangential impact mechanism will not operate. As such, there is a smooth rotary movement applied to the spindle 60. The driving force is transferred from the first bevel gear 84 to a cutting tool held within the front end of the spindle 60 via the path indicated by solid line 160. The rate of rotation of the spindle 60 versus the drive spindle 16 is determined by the gear ratios between the drive spindle 16 and the second gear 22 and the gear ratio between the second bevel gear 90 and the first bevel gear 84.

However, when the operating conditions cease to be normal and the amount of restive torque on the spindle 60 is excessive, for example during kick back where a cutting tool is prevented from further rotation within a work piece, the restive torque becomes greater than that of the threshold of the torque clutch. When the amount of restive torque on the spindle 60 is excessive, the rotation of the spindle 60 will be severely hindered or even completely stopped. However, the drive spindle 16 of the motor 10 will continue to rotate, rotationally driving the second gear 22, second shaft 28, the second bevel gear 90 and first bevel gear 84 which in turn will continue to rotationally drive the pins 92 and circular gears 94 around the axis 102 of the spindle 60. However, as rotation spindle 60 is hindered or stopped, the rotation of the cup shaped gear 70 is similarly hindered or stopped. Therefore, the torque clutch slips due to the ball bearings 108 of the torque clutch moving out of the indentations 114 in path on the side wall 112 of the cup shaped gear 70 against the spring force of the bevel washers 110 and travelling along the path, allowing the cup shape gear 70 to rotate in relation to the clutch sleeve 104. This in turn allows the annular shaped gear 78 to rotate in relation to the cup shaped gear 70. Therefore the rate of rotation of the cup shaped gear and the annular shaped gear will be different. As the circular gears 94 are meshed with the cup shaped gear 70, each of the three circular gears 94 will be caused to rotate around the pin 92 upon which they are mounted in addition to rotating around the axis 102 of the spindle 60. As the circular gears 94 rotate around the pin, they cause the annular gear 84 to rotate as it is meshed with the circular gears 94. As the cup shaped gear 70 is severely hinder or even completely stopped, there is a relative rotation between the cup shaped gear 70 and annular gear 84 and therefore a relative rotation between the sleeve 74 and spindle 60.

Because the spindle 60 is attached to the cup shaped gear 70, and the sleeve 74 is attached to the annular shape gear 84 and that the rotary drive from the motor is imparted to the planetary gear system via the circular gears 94, the direction of rotation of the sleeve 74 and spindle 60 when the torque clutch is not slipping (ie the cup shaped gear 70 and the annular shaped gear 84 are rotationally locked to each other and there is no relative rotational movement between the two) remains the same as the direction of rotation of the sleeve when the torque clutch slips (ie when there is relative rotation between the cup shaped gear 70 and the annular shaped gear 84).

As the sleeve 74 starts to rotate, the anvil 116, which is connected to the sleeve 74 via the ball bearings 132 and which is in its most forward position because the ball bearings 132 are urged to the apex 28 of the V shaped grooves 126 of the sleeve and rear walls of the U shaped recesses by the spring 118, starts to rotate with the sleeve 74. However, as the anvil 116 rotates, the two protrusions 134 engage with the two impact arms 136 which, as they are attached to the spindle 60, are either stationary or rotating much more slowly than the sleeve 74. The anvil 116 is therefore prevented from rotating further with the sleeve 74. Therefore, as the sleeve 74 continues to rotate, the ball bearings 132 are forced to travel backwards along one of the arms 130 of the V shaped grooves 126 due to the ball bearings 132 and the V shaped grooves 126 acting a cam and cam follower to accommodate the relative rotational movement between the anvil 116 and the sleeve 74. As the ball bearings 132 move backwards and as they are engaged with the rear walls of the U shaped recesses 122, they pull the anvil 116 rearwardly (left in FIG. 2) against the biasing force of the spring 118. As the anvil 116 slides rearwardly, the two protrusions 134 slide rearwardly whilst in sliding engagement with the two impact arms 136. Once the anvil has been moved rearwardly sufficiently, the two protrusions 134 disengage with the impact arms 136 and slide to the rear of the two impact arms 136. In this position, the impact arms 136 no longer hinder the rotational movement of the anvil 116. As such the anvil 116 is free to rotate. Therefore, the rotational movement of the sleeve 74 is imposed onto the anvil 116. Furthermore, as the anvil 116 is free to rotate, the spring 118 drives the anvil 116 forward, causing it to rotate on the sleeve 74 at a much faster rate than the sleeve 74 due to the ball bearings 132 travelling along the arms 130 of the V shape grooves 126 which act as cam and cam followers. As the anvil 116 moves forward and rotates, the two protrusion 134 move between and head towards the two impact arms 136. As it continues to move forward and rotate, the protrusions 134 tangentially strike impact surfaces on the sides of the two impact arms 136. As the protrusions 134 strike the two impact arms 136, they impart a tangential impact to the spindle 60. Once in engagement with the impact arms 136, the anvil 116 is prevented from further rotation relative to the spindle 60.

However, the sleeve 74 continues to rotate forcing the ball bearings 132 rearwadly along the arms 130 of the V shaped slots 126 and causing the whole process to be repeated. In this manner, the tangential impact mechanism tangentially strikes the spindle 60, which in turn transfers the tangential impacts to a cutting tool held with the front end of the spindle 60.

The size and speed of the tangential impact is determined by the mass of the anvil 116, the strength of the spring 118 and the shape of V shaped grooves 126.

The tangentially impact driving force is transferred from the first bevel gear 84 to a cutting tool held within the front end of the spindle 60 via the path indicated by solid line 162. The rate of rotation of the sleeve 74 versus the drive spindle 16 is determined by the gear ratios between the drive spindle 16 and the second gear 22, the gear ratio between the second bevel gear 90 and the first bevel gear 84 and the gear ratio of the planetary gear system. This is a different ratio to that of the spindle 60 and the drive spindle 16. This provides the benefit of having the spindle 60 rotate at one optimised rate when the hammer is operating with only a smooth rotation of the hollow spindle 60, and the sleeve 74 rotate at a second optimised rate when tangential impact mechanism is operating. The sizes of the cup shaped gear 70, circular gears 94 and annular shaped gear 78 can be determined so that the gear ratios between the drive spindle 16 and the second gear 22 and between the second bevel gear 90 and the first bevel gear 84 can be optimised for driving the spindle 60 while the ratio of the planetary gear system optimises the rate of rotation for the sleeve 74 of the tangential impact mechanism.

In order to operate the hammer drill in rotary and hammer mode, the first sleeve 26 is moved into driving engagement with the first gear 20 (downwards in FIG. 2) while the second sleeve 30 is also moved into driving engagement with the second gear 22 (downwards in FIG. 2) by the mode change mechanism. As such, rotation of the second gear 22 results in rotation of the second shaft 28 whilst the rotation of the first gear 20 results in rotation of the first shaft 24. Therefore rotation of the drive spindle 16 results in rotation of both the first and second shafts 28. The hammer mechanism and rotary mechanism then each operate as described above.

The tangential impact mechanism is described above with the use of V shape grooves 126. The use of V shaped grooves 126 allows the tangential impact mechanism to operate when the spindle is rotated in either direction as is well known in the art. If it is desired that the tangential impact mechanism should only operate in one direction of rotation, then only a single spiral groove angled in the appropriate direction is required.

The description of the invention is merely exemplary in nature and, thus, variations that do not depart from the gist of the invention are intended to be within the scope of the invention. Such variations are not to be regarded as a departure from the scope of the invention.

The invention claimed is:

1. A drill comprising:

a housing;

a motor mounted in the housing having a drive spindle;

an output spindle capable of being rotationally driven by the drive spindle via a torque clutch, the output spindle having an impact surface and a central axis; and a tangential impact mechanism for superimposing tangential impacts onto the output spindle when activated, the tangential impact mechanism comprising:

a sleeve rotatably mounted on the output spindle which is capable of being rotationally driven by the drive spindle; and an anvil rotatably mounted onto the output spindle, the anvil being connected to the sleeve so that relative rotation of the sleeve and the output spindle results in the anvil repetitively striking the impact surface;

wherein the output spindle and the sleeve are rotationally driven by the drive spindle via a gear system, the drive spindle driving the sleeve via the gear system at a first rotational rate when the torque clutch is not slipping and at a second rotational rate when the torque clutch is slipping, wherein the torque clutch is connected between two gears of the gear system and the two gears are co-axial.

2. The drill in accordance with claim 1 wherein, when the torque clutch is not slipping, the gear system provides a first ratio between an input of the gear system driven by the drive spindle and an output of the gear system which drives the sleeve and, when the clutch is slipping, the gear system provides a second ratio.

3. The drill in accordance with claim 2 wherein the first ratio is 1:1.

4. The drill in accordance with claim 1 wherein the tangential impact mechanism is activated when the torque clutch slips.

5. The drill in accordance with claim 1 wherein the two gears are rotationally connected to each other when the torque clutch is not slipping, and the two gears being rotatable relative to each other when the torque clutch is slipping.

6. The drill in accordance with claim 1 wherein the gear system comprises:

a first gear mounted on the output spindle so that rotation of the first gear results in rotation of the output spindle;

a second gear mounted on the sleeve so that rotation of the second gear results in rotation of the sleeve;

a third gear drivingly connected to the drive spindle, the third gear being meshed with the first and second gears, wherein the third gear is capable of rotationally driving the first and second gears.

7. The drill in accordance with claim 1 wherein the anvil is rotatably mounted on the sleeve.

8. The drill in accordance with claim 1 wherein the anvil can axially slide on the output spindle.

9. The drill in accordance with claim 1 wherein the sleeve is connected to the anvil via at least one cam mechanism.

10. The drill in accordance with claim 9 wherein the cam mechanism comprises:

a spiral groove formed on one of the sleeve and the anvil, the groove facing towards the other of the sleeve and the anvil; and a ball bearing located within the groove, the ball bearing being in driving engagement with the other of the sleeve and the anvil.

11. The drill in accordance with claim 1 wherein the anvil is biased by a spring towards engagement with the impact surface, the impact surface preventing rotation of the anvil on the output spindle when the anvil is in engagement with the impact surface.

12. The drill in accordance with claim 11 wherein rotation of the sleeve on the output spindle results in the anvil moving against the biasing force of the spring away from the impact surface, the movement of the anvil relative to the sleeve being controlled by the cam mechanism.

13. The drill in accordance with claim 12 wherein, upon disengagement of the anvil from the impact surface, the spring drives the anvil back into engagement with the impact surface to impart a tangential impact onto the output spindle, the movement of the anvil relative to the sleeve being controlled by the cam mechanism.

14. The drill in accordance with claim 1 wherein the output spindle is a hollow output spindle.

15. The drill in accordance with claim 14, further comprising a hammer mechanism for generating axial impacts which can be imposed on a cutting tool, the hammer mechanism comprising:

a piston capable of being reciprocatingly driven by the drive spindle via a transmission mechanism;

a ram reciprocatingly driven by the piston via an air spring; and a beat piece being repetitively struck by the ram;

wherein the piston, ram and beat piece are slideably mounted within the hollow output spindle.

16. A drill comprising:

a housing;

a motor mounted in the housing having a drive spindle;

an output spindle capable of being rotationally driven by the drive spindle via a torque clutch, the output spindle having an impact surface and a central axis; and a tangential impact mechanism for superimposing tangential impacts onto the output spindle when activated, the tangential impact mechanism comprising:

a sleeve rotatably mounted on the output spindle which is capable of being rotationally driven by the drive spindle; and an anvil rotatably mounted onto the output spindle, the anvil being connected to the sleeve so that relative rotation of the sleeve and the output spindle results in the anvil repetitively striking the impact surface;

wherein the output spindle and the sleeve are rotationally driven by the drive spindle via a gear system, the drive spindle driving the sleeve via the gear system at a first rotational rate when the torque clutch is not slipping and at a second rotational rate when the torque clutch is slipping, and wherein the gear system comprises:

a first gear mounted on the output spindle so that rotation of the first gear results in rotation of the output spindle;

a second gear mounted on the sleeve so that rotation of the second gear results in rotation of the sleeve; and a third gear drivingly connected to the drive spindle, the third gear being meshed with the first and second gears, wherein the third gear is capable of rotationally driving the first and second gears.

17. The drill in accordance with claim 16 wherein, when the torque clutch is not slipping, the gear system provides a first ratio between an input of the gear system driven by the drive spindle and an output of the gear system which drives the sleeve and, when the clutch is slipping, the gear system provides a second ratio.

18. The drill in accordance with claim 16 wherein the tangential impact mechanism is activated when the torque clutch slips.

19. The drill in accordance with claim 16 wherein the anvil is rotatably mounted on the sleeve.

20. The drill in accordance with claim 16 wherein the anvil can axially slide on the output spindle.

21. The drill in accordance with claim 16 wherein the sleeve is connected to the anvil via at least one cam mechanism.

22. The drill in accordance with claim 16 wherein the anvil is biased by a spring towards engagement with the impact surface, the impact surface preventing rotation of the anvil on the output spindle when the anvil is in engagement with the impact surface.

23. The drill in accordance with claim 22 wherein rotation of the sleeve on the output spindle results in the anvil moving against the biasing force of the spring away from the impact surface, the movement of the anvil relative to the sleeve being controlled by the cam mechanism.

24. The drill in accordance with claim 16 wherein the output spindle is a hollow output spindle.

25. A drill comprising:

a housing;

a motor mounted in the housing having a drive spindle;

an output spindle capable of being rotationally driven by the drive spindle via a torque clutch, the output spindle having an impact surface and a central axis; and a tangential impact mechanism for superimposing tangential impacts onto the output spindle when activated, the tangential impact mechanism comprising:

a sleeve rotatably mounted on the output spindle which is capable of being rotationally driven by the drive spindle; and an anvil rotatably mounted onto the output spindle, the anvil being connected to the sleeve so that relative rotation of the sleeve and the output spindle results in the anvil repetitively striking the impact surface;

wherein the output spindle and the sleeve are rotationally driven by the drive spindle via a gear system, the drive spindle driving the sleeve via the gear system at a first rotational rate when the torque clutch is not slipping and at a second rotational rate when the torque clutch is slipping, and wherein the output spindle is a hollow output spindle.

26. The drill in accordance to claim 25 further comprising a hammer mechanism for generating axial impacts which can be imposed on a cutting tool, the hammer mechanism comprising:

a piston capable of being reciprocatingly driven by the drive spindle via a transmission mechanism;

a ram reciprocatingly driven by the piston via an air spring; and a beat piece being repetitively struck by the ram;

wherein the piston, ram and beat piece are slideably mounted within the hollow output spindle.

27. The drill in accordance with claim 25 wherein, when the torque clutch is not slipping, the gear system provides a first ratio between an input of the gear system driven by the drive spindle and an output of the gear system which drives the sleeve and, when the clutch is slipping, the gear system provides a second ratio.

28. The drill in accordance with claim 25 wherein the tangential impact mechanism is activated when the torque clutch slips.

29. The drill in accordance with claim 25 wherein the anvil is rotatably mounted on the sleeve.

30. The drill in accordance with claim 25 wherein the anvil can axially slide on the output spindle.

31. The drill in accordance with claim 25 wherein the sleeve is connected to the anvil via at least one cam mechanism.

32. The drill in accordance with claim 25 wherein the anvil is biased by a spring towards engagement with the impact surface, the impact surface preventing rotation of the anvil on the output spindle when the anvil is in engagement with the impact surface.

33. A drill comprising:

a housing;

a motor mounted in the housing having a drive spindle;

an output spindle capable of being rotationally driven by the drive spindle via a torque clutch, the output spindle having an impact surface and a central axis; and a tangential impact mechanism for superimposing tangential impacts onto the output spindle when activated, the tangential impact mechanism comprising:

a sleeve rotatably mounted on the output spindle which is capable of being rotationally driven by the drive spindle; and an anvil rotatably mounted onto the output spindle, the anvil being connected to the sleeve so that relative rotation of the sleeve and the output spindle results in the anvil repetitively striking the impact surface;

wherein the output spindle and the sleeve are rotationally driven by the drive spindle via a gear system, the drive spindle driving the sleeve via the gear system at a first rotational rate when the torque clutch is not slipping and at a second rotational rate when the torque clutch is slipping, wherein the anvil is biased by a spring towards engagement with the impact surface, the impact surface preventing rotation of the anvil on the output spindle when the anvil is in engagement with the impact surface, and wherein rotation of the sleeve on the output spindle results in the anvil moving against the biasing force of the spring away from the impact surface, the movement of the anvil relative to the sleeve being controlled by the cam mechanism.

34. The drill in accordance with claim 33 wherein, upon disengagement of the anvil from the impact surface, the spring drives the anvil back into engagement with the impact surface to impart a tangential impact onto the output spindle, the movement of the anvil relative to the sleeve being controlled by the cam mechanism.

* * * * *